US007344285B2

(12) United States Patent
Cseh et al.

(10) Patent No.: US 7,344,285 B2
(45) Date of Patent: Mar. 18, 2008

(54) ELECTRIC LAMP WITH HEAT RESISTANT SHADE

(75) Inventors: Géza Cseh, Budapest (HU); Péter Lajos Nagy, Budapest (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/298,337

(22) Filed: Dec. 7, 2005

(65) Prior Publication Data

US 2007/0127247 A1 Jun. 7, 2007

(51) Int. Cl.
*F21V 11/00* (2006.01)

(52) U.S. Cl. ..... 362/356; 362/353

(58) Field of Classification Search ..... 362/356, 362/353

See application file for complete search history.

(56) References Cited

U.S. PATENT DOCUMENTS 2,014,039 A * 9/1935 Cole ..... 362/308
2,087,749 A * 7/1937 Bookman, Jr. ..... 362/444
2,089,610 A * 8/1937 Kloos ..... 362/348
2,496,482 A * 2/1950 Madan et al. ..... 362/360
2,659,809 A * 11/1953 Melia ..... 362/356
2,850,731 A * 9/1958 Carlson ..... 343/720
3,308,290 A * 3/1967 Brown ..... 362/295
3,323,974 A * 6/1967 Jablonski et al. ..... 442/295
3,443,083 A * 5/1969 Curran ..... 362/643
4,001,576 A * 1/1977 Goddard ..... 362/307
4,392,190 A * 7/1983 Upton ..... 362/281
4,869,940 A * 9/1989 Shoshani ..... 428/38
4,880,193 A * 11/1989 Warshawsky ..... 248/122.1
5,918,971 A * 7/1999 Yu ..... 362/448
6,398,384 B2 * 6/2002 Siminovitch et al. ..... 362/225

* cited by examiner

*Primary Examiner*—Hargobind S. Sawhney
(74) *Attorney, Agent, or Firm*—Fay Sharpe LLP

(57) ABSTRACT

An electric lamp comprises a lamp base and an envelope having a common axis, a support member having a fixing gap around the common axis, and an elastic shade of substantially conical shape. The shade has a first end portion inserted in the fixing gap and a second end portion remote from the lamp base. The diameter of the first end portion taken perpendicularly to said axis is smaller than the diameter of the second end portion, and the elastic shade is made of heat resistant plastic foil.

28 Claims, 6 Drawing Sheets

ELECTRIC LAMP WITH HEAT RESISTANT SHADE

BACKGROUND OF THE INVENTION

This invention relates to an electric lamp with heat resistant shade.

In case of different lamps mounted with electric burner, a glass reflector structure is used, in which the light-directing feature is provided for by a side-wall of the reflector covered by a metallic layer. The glass side-wall of the reflector ends in a plane or convex front wall, in other words the reflector has a lens for emitting the light beam. The glass reflector constitutes a rigid, fragile structure.

U.S. Pat. No. 4,548,589 discloses a halogen bulb lamp assembly manufactured by mounting a previously aligned halogen bulb unit in a one-piece molded plastic rectangular reflector with a mirrorized paraboloidal inner surface. The halogen bulb unit has a pair of spaced connector pins that are coated with an epoxy adhesive and inserted into a pair of stepped through bores in the reflector. This construction uses plastic that is less fragile, however, the molding procedure is an expensive technology when shapes following different demands are quickly changed.

If the radiation flux at the reflecting wall is high, the thermal load of the plastic wall is considerable and the danger of softening may occur. U.S. Pat. No. 4,380,794 discloses a surgical lamp including a thermoplastic reflector, which reflects visible light but passes infrared radiation. The reflector is fabricated from molded polyetherimide plastic resin. A dichroic coating is vacuum deposited directly upon the front surface of the reflector. This reflector eliminates the excess thermal load, but the quite large plastic reflector element can easily be damaged. The molding technology of the reflector makes also this construction expensive as well.

Thus there is a particular need for a lamp with an easily variable and still not expensive element of directing light. There is also a need for a lamp with a unit of directing light, which is not fragile and not sensitive to mechanical damages, such as, for example, unintentional dropping. It is also desirable that the lamp can be manufactured easily.

SUMMARY OF THE INVENTION

In an exemplary embodiment of the invention, an electric lamp with heat resistant shade is provided. The lamp comprises a lamp base and an envelope having a common axis, a support member having a fixing gap around the common axis, and an elastic shade of substantially conical shape. The shade has a first end portion inserted in the fixing gap and a second end portion remote from the lamp base. The first end portion has a diameter smaller than the diameter of the second end portion. The elastic shade is made of heat resistant plastic foil.

In an exemplary embodiment of another aspect of the invention, a shade for use in an electric lamp is provided. The shade is elastic and has a substantially conical shape with a longitudinal axis. It has a first end portion in the direction of the axis. The first end portion has an edge substantially perpendicular to said axis. The first end portion with its edge is adapted for insertion in a fixing gap. The shade also has a second end portion, and the diameter of the first end portion taken substantially perpendicularly to said axis is smaller than the diameter of the second end portion. The elastic shade is made of heat resistant plastic foil.

The shade made of heat resistant plastic foil is capable of replacing traditional light directing glass reflectors of lamps.

Optical and visual features of the shade can be selected in a highly flexible way. The second end portion of the shade can be tailored according to any aesthetical purpose.

This substantially conical shade structure also provides for the required mechanical resistance against damages due to the elastic shade. Furthermore this kind of shade can easily be adapted to any change in its shape, color or overall appearance.

Electric lamps manufactured with such shades have a lightweight upper part, and the mass center of the lamp is located at about the lamp base. Furthermore, the mounted shade introduces a considerable air resistance. This involves a consequence that an unintentionally dropped lamp will impact against the floor at its base portion, therefore lamp breaking is less likely than in the case of a conventional lamp with glass or plastic reflector. It is also an advantage over the conventional plastic or glass reflector lamps, that the proposed lamps can be manufactured easily, cheaply and reliably. In addition, the electric lamp with heat resistant plastic shade is shock-resistant during shipping due to the elastic damping effect of the shade.

BRIEF DESCRIPTION OF DRAWINGS

The invention will now be described with reference to the enclosed drawings, where.

DETAILED DESCRIPTION OF THE INVENTION

Figure 1:
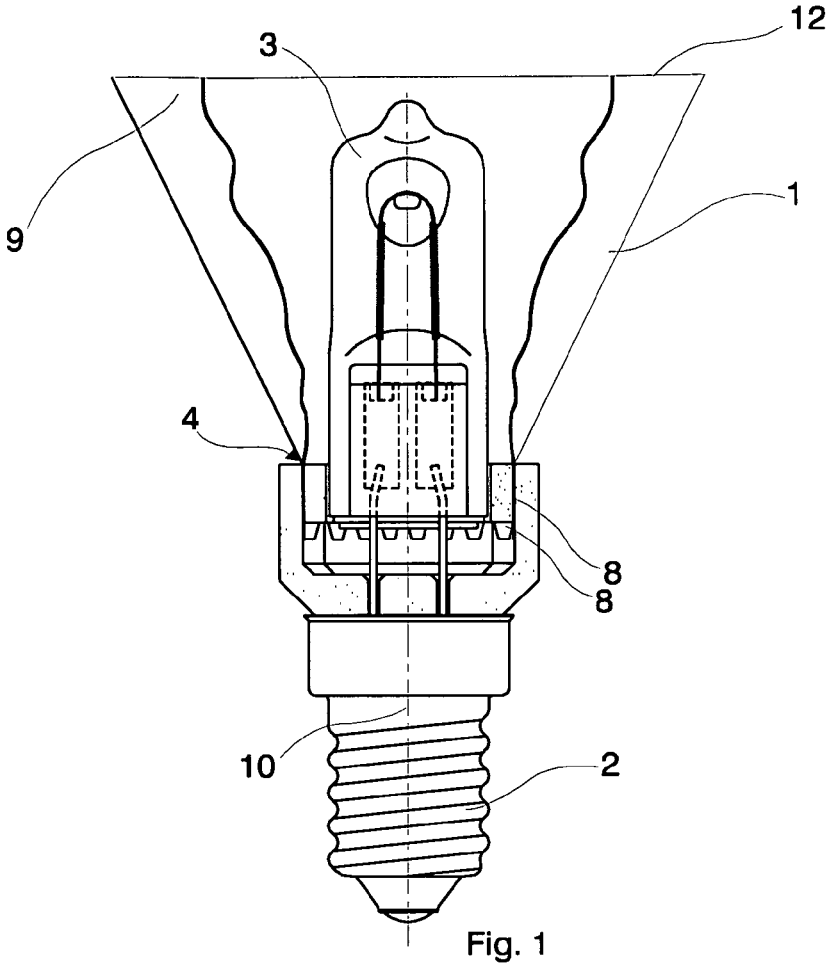
FIG. 1 is a lamp with a shade in partial sectional view.

The same functional elements of different embodiments in the drawings are identified by the same reference numbers.

In FIG. 1, an exemplary embodiment of the invention is shown, as a halogen lamp with a heat resistant shade 1. The exemplary halogen lamp is mounted with a lamp base 2, an envelope 3, and a ceramic support member 4 is disposed between them. An elastic shade 1 of substantially conical shape is mounted around the envelope 3. A substantially conical shape in the context of the present specification means a frustum-conical shape, a slightly conical, almost cylindrical shape as well as a broadening curved shape including a paraboloidal shape. A curved shape can be manufactured, for example, by pressing technology.

The lamp base 2 and the envelope 3 have a common axis 10, which substantially coincides with the axis of the shade 1 that has a frustum-conical shape in FIG. 1. There is a fixing gap 7 within the ceramic support member 4, which extends around the axis 10. A first end portion 8 of the shade 1 at its lower side is fitted in the fixing gap 7. The shade 1 at the second end portion 9 is terminated in an edge 12 derived from a cutting plane being substantially perpendicular to the axis 10.

Figure 2:
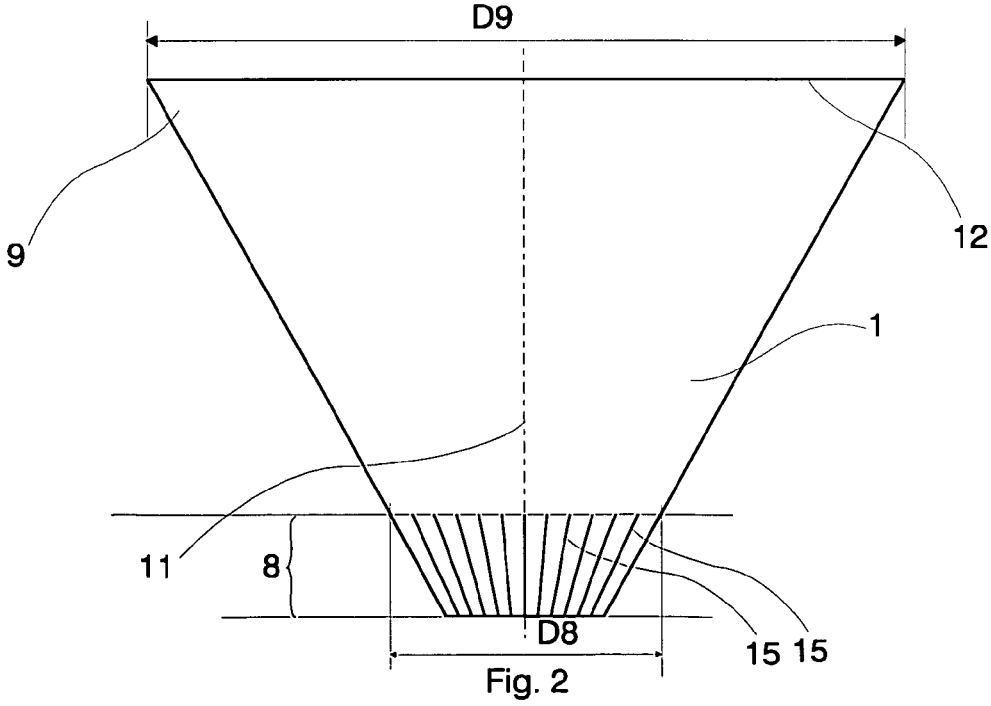
FIG. 2 is a front view of a shade having segments separated by cuts.

The shade 1 of FIG. 1 is illustrated in a preliminary state of manufacture in FIG. 2. The shade 1 appears in a form of cone-frustum with an axis 11 and the first end portion 8 having a diameter D8 and the second end portion 9 having a diameter D9. These end portions 8 and 9 are defined in a way that the diameter D8 of the first end portion 8, taken perpendicularly to the axis 11, is smaller than the diameter D9 of the second end portion 9. The lower edge at the first end portion 8 is substantially perpendicular to the axis 11. At the first end portion 8, the shade 1 is ripped by a plurality of cuts 15. The role of these cuts 15 will be described later.

Figure 14:
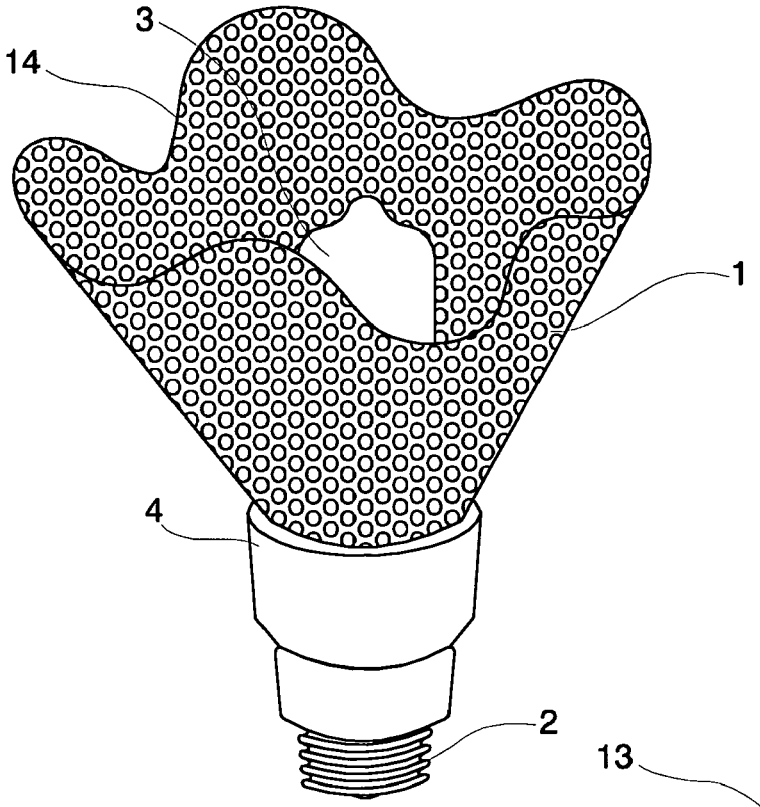
FIG. 14 is a perspective view of a lamp with a shade patterned by punching.
Figure 15:
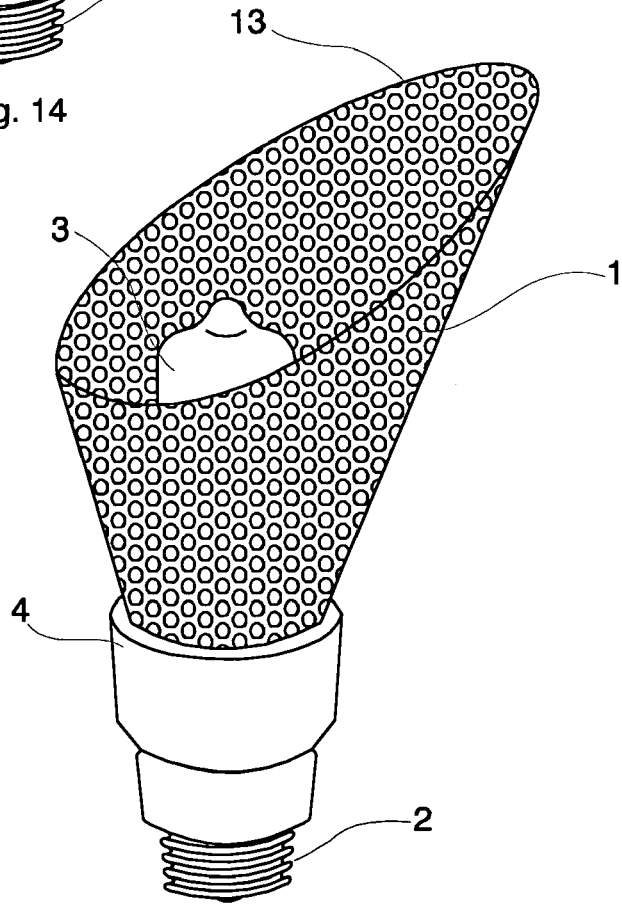
FIG. 15 is a perspective view of the lamp of FIG. 11 with a shade patterned by punching.

The shade 1 can preferably be made of elastic PTFE foil. This foil material itself is known in different forms. For example, a 0.2-0.25 mm thick PTFE foil is white translucent or opaque, and it is suitable for manufacturing opal type lamps due to its light scattering properties. However textured or patterned PTFE foils are also available. The pattern can either be made by cutting out or punching the foil, as illustrated in FIGS. 14 and 15, or can be colored or textured. These kinds of foils can be combined into a single or a laminated multiple PTFE foil.

In spite of its advantageous thermo-mechanical and optical properties, such as high elasticity, heat resistance, very low absorption in visible and IR range, and Rayleigh scattering of the light, PTFE was not formerly used in electric lamps as closed or open envelope or built-in shades due to its relatively high price. However, a PTFE foil requires only small amount of raw material, therefore the cost/unit ratio can be maintained competitively low. Furthermore, different decorative light scattering surfaces can be created from PTFE foils, even in different colors and textures. The foil can also be colored, patterned or laminated as mentioned before and tailored at its upper edge. These various shapes of the shades may involve a special dedicated visual effect that the user of the lamp wishes. The shade is set around the light source, particularly a mains voltage halogen insert lamp, thus it may constitute a versatile means for creating custom designed visual and lighting effects.

Figure 3:
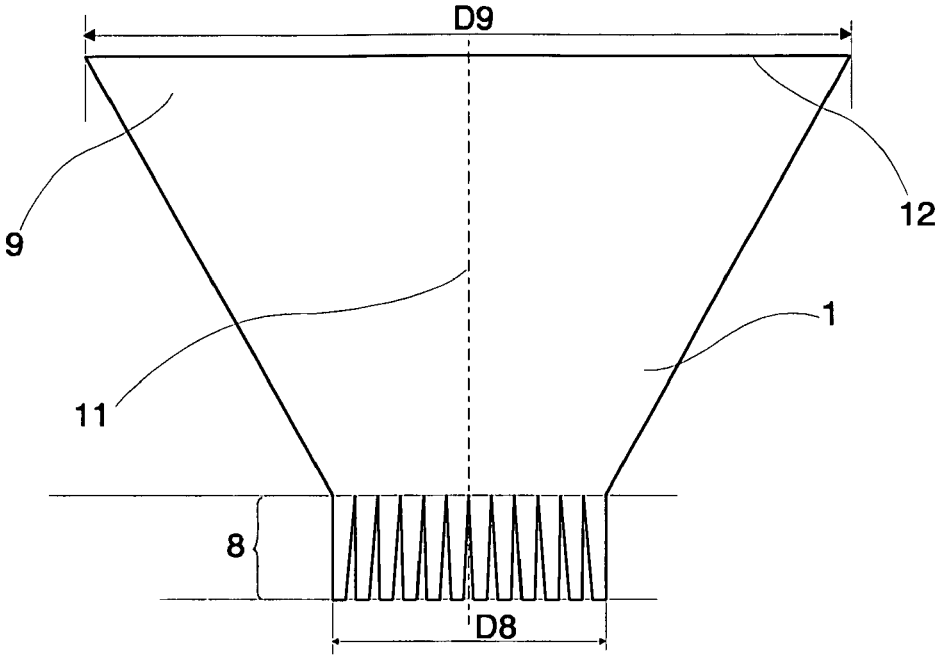
FIG. 3 is a front view of the shade of FIG. 3 with folded out segments.
Figure 4:
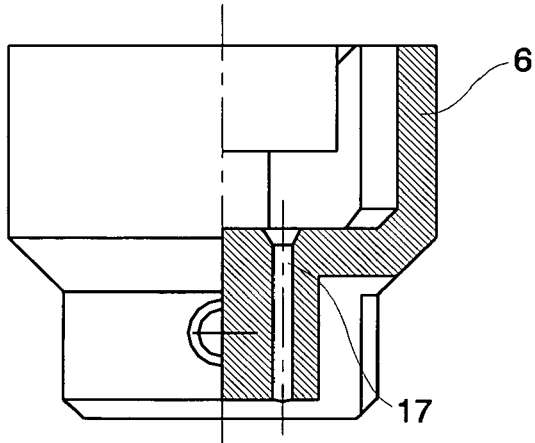
FIG. 4 is a partial sectional front view of an outer part of a support member.
Figure 5:
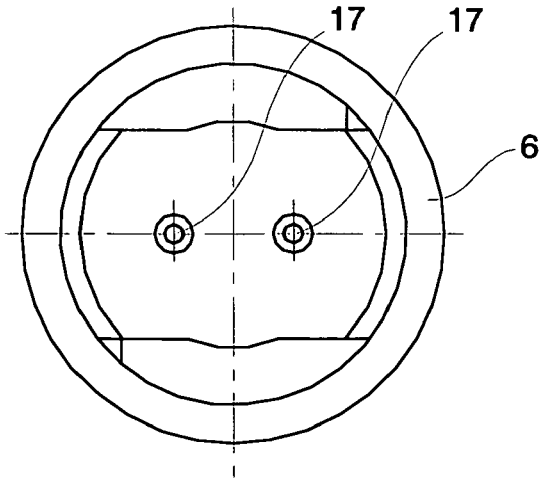
FIG. 5 is a top view of the outer part of a support member of FIG. 4.
Figure 6:
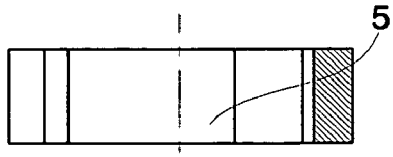
FIG. 6 is a side view of an inner part of a support member.
Figure 7:
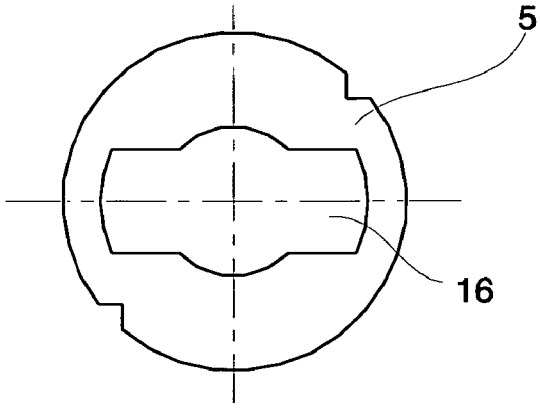
FIG. 7 is a top view of the inner part of a support member a FIG. 6.

The shade of FIG. 2 can be seen in FIG. 3 in a state when the first end portion 8 having an edge substantially perpendicular to the axis 11 is ripped by a plurality of cuts 15 dividing the first end portion 8 into protruding segments, and the segments are folded out into a substantially cylindrical surface. This surface may be attached to the ceramic support member 4.

A heat resistant ceramic support member 4 is shown in FIGS. 4-10, which support member 4 is used to keep the shade 1 in a position around the envelope 3 of the lamp. The ceramic support member 4 is made of two concentric parts, an inner part 5 as illustrated in side and top views in FIG. 4 and 5, respectively, and an outer part 6, as illustrated in side and top views in FIG. 6 and 7, respectively. Both parts 5 and 6 are made of cheap and heat resistant ceramic material. The outer part 6 shown in FIG. 3 is built together with the base of a lamp. When the inner part 5 is inserted into the inner hollow space of the outer part 6 in a concentric position, the mounted ceramic support member 4 defines a fixing gap 7 between the inner part 5 and the outer part 6 of the support member 4. This fixing gap 7 allows the shade 1 to be gripped in the support member 4. The inner part 5, as illustrated in top view in FIG. 7 separately, includes an aperture 16 into which the envelope of the electric lamp is fitted. Similarly, the outer part 6, as illustrated in top view of FIG. 5, includes two holes 17 through which the lead-in wires of the halogen lamp is pushed. The lead-in wires are then connected to the lamp base 2. The first end portion 8 of the shade ripped by a plurality of axial cuts 15 is inserted in the fixing gap 7. The second end portion 9 remote from the lamp base 2 can be tailored in a desired manner.

Figure 8:
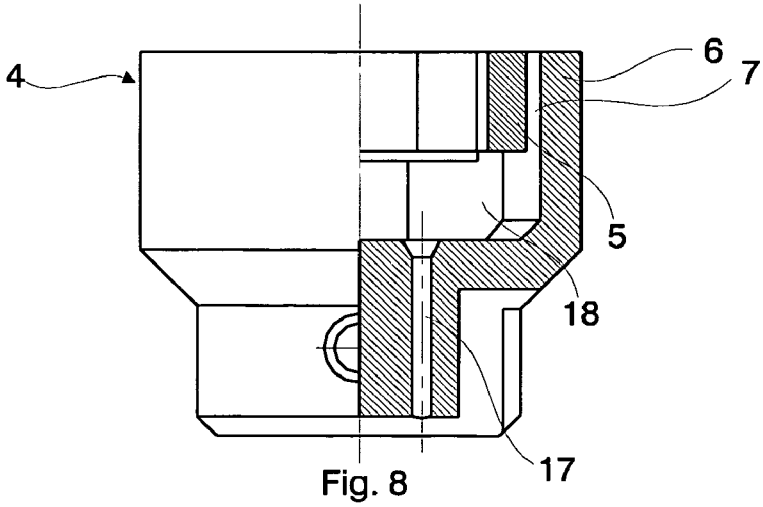
FIG. 8 is a partial sectional front view of a support member without shade.
Figure 9:
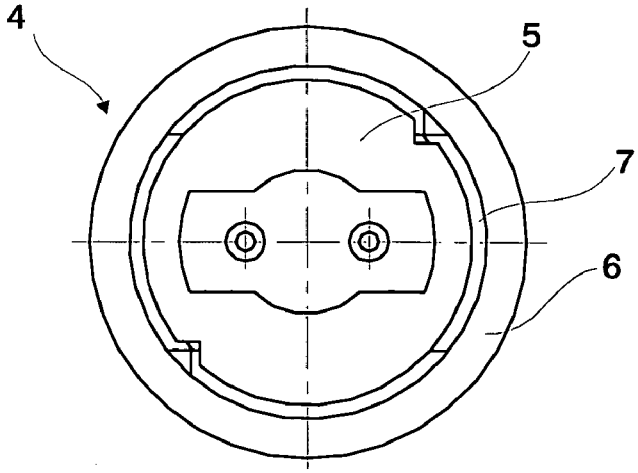
FIG. 9 is a top view of the support member of FIG. 8.

FIGS. 8 and 9 show the mounted support member 4 without the shade 1 in side and top view, respectively. The fixing gap 7 is empty, which would make the joint between the inner part 5 and the outer part 6 loose. However in the course of one advantageous way of assembling the lamp, the first end portion 8 and then the inner part 5 are inserted into the outer part 6. The downward motion of the of the inner part 5 inside the conical shade 1 causes the segments of the ripped first end portion 8 to fold out and to get pressed into the fixing gap 7. The lamp is also inserted into the aperture 16 while the lead-in wires are pushed through the holes 17. There is a hollow space 18 in the mounted support member 4 as illustrated in FIG. 8, which can be filled in with cement or similar adhesive substance. The cement can be applied right before assembling the support member 4, the downward motion of the inner part 5 ensures that the cement fills in the hollow space 18 and surrounds a pinched end portion of the lamp, and intrudes into the holes 17 and surrounds the lead-in wires as well. When the cement hardens, the support member 4 and the shade 1 mounted together constitute a solid entity.

Figure 10:
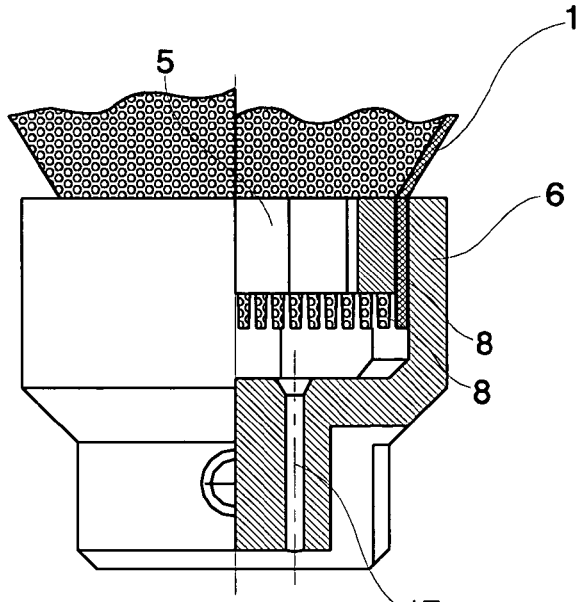
FIG. 10 is a partial sectional front view of a support member with a shade.

FIG. 10 shows the mounted support member 4 together with the shade 1 inserted and gripped in the fixing gap 7.

The mounted support member 4 with the fixed shade 1 is disposed in a position around the common axis of the lamp base 2 and the envelope 3, or in other words all of these elements are aligned along a common symmetry axis.

The elastic PTFE foil material of the shade 1 may be light reflecting on the inner side thereof. This can be accomplished, for example, by a metallic light reflecting layer applied to the inner side of the substantially conical shade 1. The technology of coating or depositing a light-reflecting layer is well known in the lighting industry. This lamp construction can result in a product functionally equivalent to conventional halogen lamps with glass outer reflector.

Figure 11:
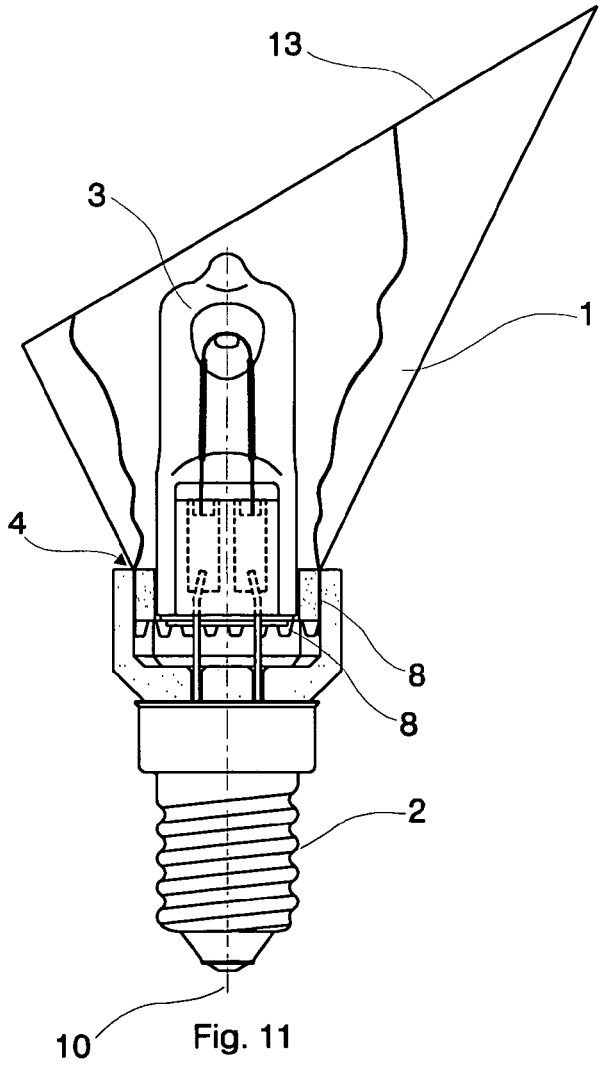
FIG. 11 is a partial sectional front view of a lamp with slant tailored shade.

As FIG. 11 shows, the substantially conical shade 1 may be tailored at its second end portion 9 along an edge 13 derived from a cutting plane being slant to the common axis 10 of the lamp base 2 and the envelope 3. The support member 4 with the first end portion 8 of the shade 1 has the same construction as that of FIG. 1. This lamp with shade structure can provide for an asymmetric visual lighting effect.

Figure 12:
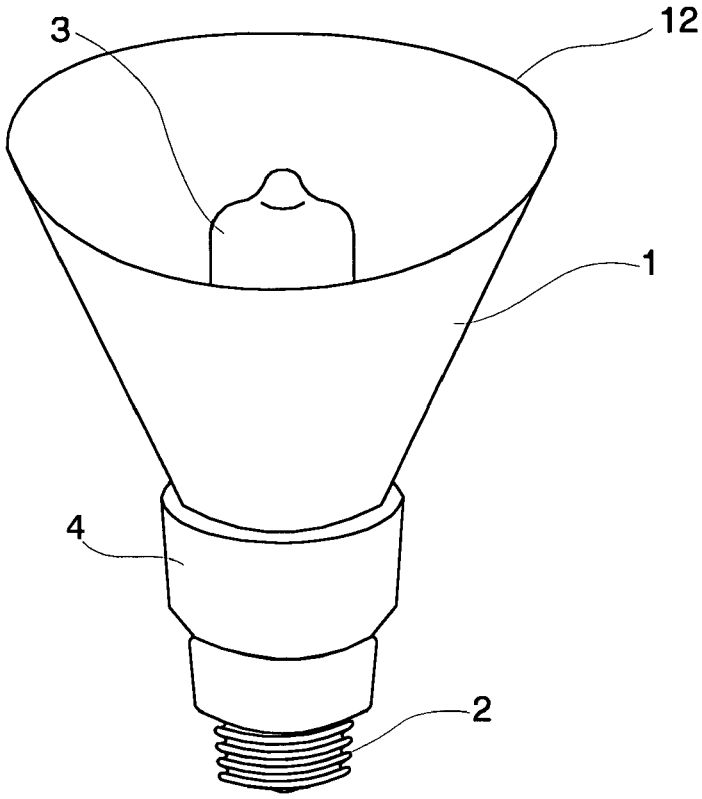
FIG. 12 is a perspective view of a lamp with straight tailored shade.

As illustrated in FIG. 12, the substantially conical shade 1 may extend over the envelope 3 of the lamp in the direction of the common axis of the lamp base 2 and the envelope 3.

Figure 13:
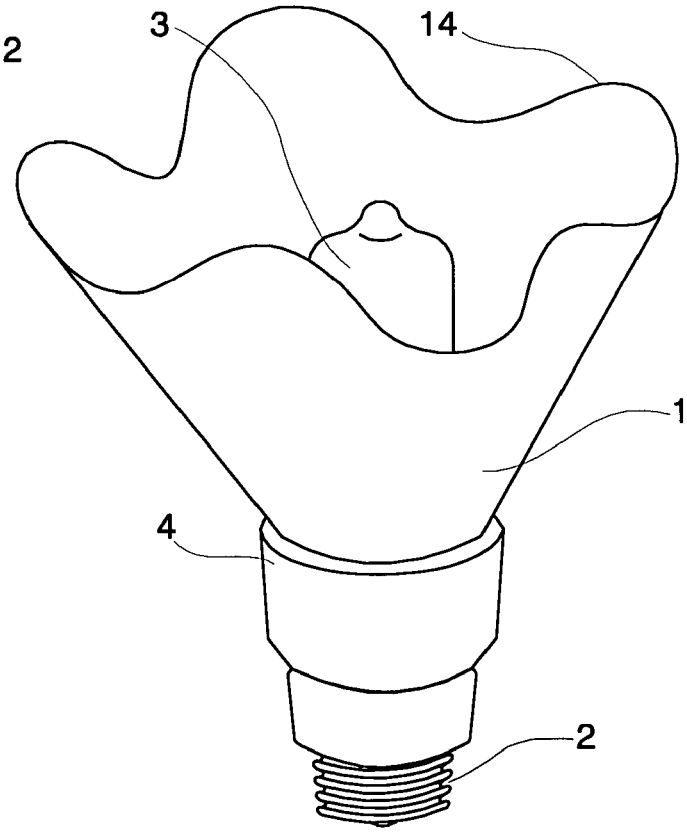
FIG. 13 is a perspective view of a lamp with a shade of wavy upper edge.

As shown in FIG. 13, the substantially conical shade 1 may be tailored at its second end portion 9 along an individually shaped upper edge line 14. The upper edge line 14 is wavy in FIG. 13. This line may be of any form other than illustrated in FIG. 12 in order to provide for a dedicated lighting effect.

FIG. 14 shows a possible lamp and shade structure similar to that of FIG. 13, with the difference that a structured punching of the PTFE foil material patterns the shade 1.

FIG. 15 illustrates a further possible lamp and shade structure similar to that of FIG. 11, with the difference that a structured punching the PTFE foil material also patterns the shade 1.

The foregoing have been illustrative, but non-limiting examples of the practice of the invention. As will be appreciated by those skilled in the art, other configurations, lamp and shade constructions may be practiced within the scope of the attached claims. Those skilled in the art will also appreciate that the invention is also applicable to electric lamps made of different light emitting bulbs.

The invention claimed is:

1. An electric lamp with heat resistant shade, the lamp comprising:

a lamp base and an envelope having a common axis, a support member having a fixing gap around the common axis, and an elastic shade of substantially conical shape, the shade having a first end portion including a plurality of protruding segments inserted in the fixing gap, the segments at least partially securing the shade to the support member, and a second end portion remote from the lamp base, the diameter of the first end portion taken perpendicularly to said axis being smaller than the diameter of the second end portion, and the elastic shade being made of heat resistant plastic foil.

2. The electric lamp of claim 1, in which the support member is made of two concentric parts, an inner part and an outer part integrally formed with the support member, and the fixing gap is between the inner part and the outer part of the support member.

3. The electric lamp of claim 2, in which the plurality of segments are gripped in the fixing gap between the inner part and the outer part of the support member, the plurality of segments together forming a substantially cylindrical surface.

4. The electric lamp of claim 2, in which the support member comprises a hollow space between the inner part and the outer part, which hollow space is filled in with cement or adhesive material.

5. The electric lamp of claim 1, in which the heat resistant plastic foil is a PTFE foil.

6. The electric lamp of claim 5, in which the PTFE foil is opaque.

7. The electric lamp of claim 5, in which the PTFE foil is colored.

8. The electric lamp of claim 1, in which the heat resistant plastic foil is patterned.

9. The electric lamp of claim 1, in which the heat resistant plastic foil is light reflecting on the inner side of the substantially conical shade.

10. The electric lamp of claim 9, in which the heat resistant plastic foil is covered by a metallic light-reflecting layer.

11. The electric lamp of claim 1, in which the second end portion of the substantially conical shade is tailored along an edge derived from a cutting plane being substantially perpendicular to the common axis of the lamp base and the envelope.

12. The electric lamp of claim 1, in which the second end portion of the substantially conical shade is tailored along an edge derived from a cutting a plane being slant to the common axis of the lamp base and the envelope.

13. The electric lamp of claim 1, in which the second end portion of the substantially conical shade is tailored along a wavy edge line.

14. The electric lamp of claim 1, in which the shade extends over the envelope of the lamp in a direction of the common axis of the lamp base and the envelope.

15. The electric lamp of claim 1, in which the support member is made of ceramic material.

16. A lamp shade for use in an electric lamp, the lamp shade comprising: an elastic shade of substantially conical shape having a longitudinal axis, and having a first end portion in the direction of the axis, the first end portion having a plurality of foldable segments, adjacent segments being separated by a cut line, and an edge being substantially perpendicular to said axis, and inserted in a fixing gap, the shade having a second end portion, and the diameter of the first end portion taken substantially perpendicularly to said axis being smaller than the diameter of the second end portion, and the elastic shade being made of heat resistant plastic foil.

17. The lamp shade of claim 16, in which the heat resistant plastic foil is a PTFE foil.

18. The lamp shade of claim 17, in which the PTFE foil is opaque.

19. The lamp shade of claim 17, in which the PTFE foil is colored.

20. The lamp shade of claim 16, in which the heat resistant plastic foil is patterned.

21. The lamp shade of claim 16, in which the heat resistant plastic foil is light reflecting on the inner side of the substantially conical shade.

22. The lamp shade of claim 21, in which the heat resistant plastic foil is covered by a metallic light reflecting layer.

23. The lamp shade of claim 16, in which the first end portion of the shade includes a plurality of cuts dividing the first end portion into the plurality of protruding segments, and the segments foldable into a substantially cylindrical surface when inserted into the fixing gap.

24. The lamp shade of claim 16, in which the heat resistant plastic foil is a laminated multiple foil.

25. An electric lamp with heat resistant shade, the lamp comprising:

a lamp base and an envelope having a common axis, a support member including an integral outer part and a separate inner part, the inner and outer parts defining a fixing gap around the common axis, and an elastic shade of substantially conical shape, the shade having a first end portion including a plurality of protruding segments, the segments located in the fixing gap, the segments forming a substantially cylindrical surface in the fixing gap, and a second end portion remote from the lamp base, and the elastic shade being made of heat resistant plastic foil.

26. The electric lamp of claim 25, in which the inner part includes an aperture, the shape of the aperture being similar to a cross-sectional shape of the envelope.

27. The electric lamp of claim 25, in which the outer part includes a pair of spaced apart holes for receiving lead-in wires of the lamp.

28. The electric lamp of claim 25, in which the support member comprises a hollow space between the inner part and the outer part, which hollow space is filled in with cement or adhesive material for fixedly securing the shade to the support member.

* * * * *